United States Patent [19]

Roma

[11] 4,253,938

[45] Mar. 3, 1981

[54] PROCESS FOR RETORTING OIL PRODUCTS CONTAINED IN SHALES AND SANDS

[75] Inventor: Carlo Roma, Rome, Italy

[73] Assignee: Square S.p.A., Coira, Switzerland

[21] Appl. No.: 105,470

[22] Filed: Dec. 19, 1979

[30] Foreign Application Priority Data

Sep. 21, 1979 [IT] Italy ..... 50323 A/79

[51] Int. Cl.[3] ..... C10G 1/00

[52] U.S. Cl. ..... 208/11 R; 208/8 R

[58] Field of Search ..... 208/8 R, 11 R

[56] References Cited

U.S. PATENT DOCUMENTS

| | | | |
|---|---|---|---|
| 3,560,369 | 2/1971 | Rowland et al. | 208/11 R |
| 4,152,243 | 5/1979 | Legille et al. | 208/11 R |

*Primary Examiner*—Delbert E. Gantz
*Assistant Examiner*—William G. Wright

[57] ABSTRACT

A plant for retorting oil products contained in shales and sands comprising a continuous retorting in a substantially horizontal retort furnace having any cross-section, into which said shales and sands are introduced by means of hoppers and metering devices and placed on metal conveyors moving in counter-current to gases, means being provided for placing said shales and sands onto said conveyors with a suitable thickness and for stirring the shales and sands, one or more combustion chambers arranged outside said retort furnace, in which hot gases are produced, and one or more input zones along the retort furnace for the admission of hot gases into the retort furnace which hot gases mix with preheated circulating gases at the expenses of the sensitive heat of the exhausted shale and sand material, a direct contact condenser at the furnace head, provided for condensing distilled oil products by a cold fluid and a decantation tank arranged beneath said condenser for depurating the process gases from the dust.

In the continuous process for retorting oil product contained in shales and sands, carried out in said plant, the shale and sand material is caused to pass through a horizontal heating and distillation step in counter-current to hot gases which convey vapors to a condensation and dust separation step, from which uncondensed gases, substantially containing carbon dioxide, hydrogen, light hydrocarbon fractions, nitrogen and steam are recycled into the distillation step and the condensed oils from said distillation step, as well the fraction of oil that can be extracted from the tunnel retort in liquid phase, are caused to flow out, and decanted and submitted to successive treatments.

3 Claims, 2 Drawing Figures

PROCESS FOR RETORTING OIL PRODUCTS CONTAINED IN SHALES AND SANDS

The present invention relates to a plant and a process for retorting petroliferous products contained in shales and sands.

As it is well known, the interest of the industrialized countries in obtaining at competitive prices hydrocarbons from the asphaltic shales and tar sands is more and more increasing.

BACKGROUND OF THE INVENTION

Many processes have been experimented and put into service in the past, i.e., in France (1938), Brazil (1881), Australia (1865), China (1881), Scotland (1862), Spain (1822), Italy (1937 Ing, F. Roma process, Italian Pat. No. 329457), South Africa (1935), Sweden (1938), USSR (1922) and in U.S.A. before the year 1858.

With the exclusion of the "in situ" processes, i.e. with underground heating and combusion, all the "surface processes" are based on the use of retorts. The most important available processes at the present time are the so-called "Development Engineering Inc. -Paraho process", the "Tosco II", the "Union Oil", the "Petrosix", the "Institue of Gas Technology IGT", "Hytort" (U.S. Pat. Nos. 4,003,821; 3,891,403; 3,992,295; 3,929,615; 3,703,052), the "Lurgi Ruhrgas", "NTU-" (U.S. Pat. Nos. 1,469,678; 1,536,696), and the so-called "Circular Grate Process" (U.S. Pat. Nos. 4,058,905 and 4,082,645).

The process could be classified in processes "solid-to-solid", in which the heat is transferred to the shale oil by means of balls (Tosco II), heated intert materials, spent shale or coke (Lurgi) or in processes with internal or external heating. The internal heating processes envisage the partial combustion into a retort of the oil or gas products of the shale or tar sands, i.e. the processes Bureau of Mines, Paraho Developement Engineering Inc., Union Oil. In the external heating processes the gas for the process is heated outside the retort by means of surface heat exchangers as in the Union Oil, IGT and Petrosix processes. This last process is very similar to the mentioned Ing, F. Roma process with the only difference that the Roma patent envisaged two condensers having the purpose of recovering the heat of the processes gases and condensing the oil product in one of the condensers.

All the mentioned processes and the others not yet industrially proved envisage costly and large heat exchangers, necessary for the condensation of oil products and/or heating the process gas, provided with heat transfer surfaces, which are difficult to operate and to maintain, costly and not always efficient equipments for dust depuration such as cyclones and electrostatic precipitators and moreover envisage vertical retorts or rotating drum or grates or a sealed screw conveyor (Lurgi), which cause a high pressure drop and therefore a high energy absorption for the circulation of gases.

SUMMARY OF THE INVENTION

An object of the present invention is that to provide a plant which avoids said disadvantages, operates at a very high production rate, avoids the use of heat exchangers and cyclones or electrostatic filters and is apt to employ circulating fans of highflow-rate and low pressure drop through the retort and condensers with consequent low energy absorption also for the transportation of the shale oil and tar sands.

Furthermore it requires very low capital and operating costs per unit of shale or tar sand treated in the plant, small amount of water and has favourable characteristics for environmental protection.

The plant is mainly characterized by a special retort furnace consisting in a horizontal tunnel, of square, rectangular, circular, semi-elliptical, etc. section, in which are installed one or more steel belt conveyors for inst. a belt of stainless steel—or vibrating plates or apron conveyors, etc. fed by one or more sealed hoppers with the crushed shales and/or sands. The plant can be also be provided with a direct contact condenser, and one or more combustion chambers separated from the tunnel for producing the gases necessary for heating the materials to be processed, which are moving in counterflow with the shale or sands put on the conveyors with appropriate thickness of layer by a feeding equipment and then stirred by means of suitable devices and tools.

The plant is also characterized by a combination between the tunnel retort and the direct contact condenser consisting of a chamber closed on the upper part, in which uncondensible process gases are collected at the pressure of the tunnel retort which pressure is approximately at atmospheric pressure. A further feature of the plant consists in the operation of the process gases which are in closed cycle, and which are preheated in the first part of the tunnel by the already retorted shales or sands and finally heated to the maximum process temperature by adding to them the gases obtained by a combustion performed in one or more separated chambers. After the addition of the combusted gases, the process gases are at the temperature necessary for the process and have a controlled composition suitable for an easy distillation of the oil products of the shales and tar sands, thus allowing an optimum control of the process by controlling the conveying speed of the shales or sands and gases flow rates and speeds, as well as their temperatures.

The invention will be now disclosed in a not limitative embodiment thereof with reference to the drawings, in which.

DESCRIPTION OF THE PREFERRED EMBODIMENTS

Figure 1:
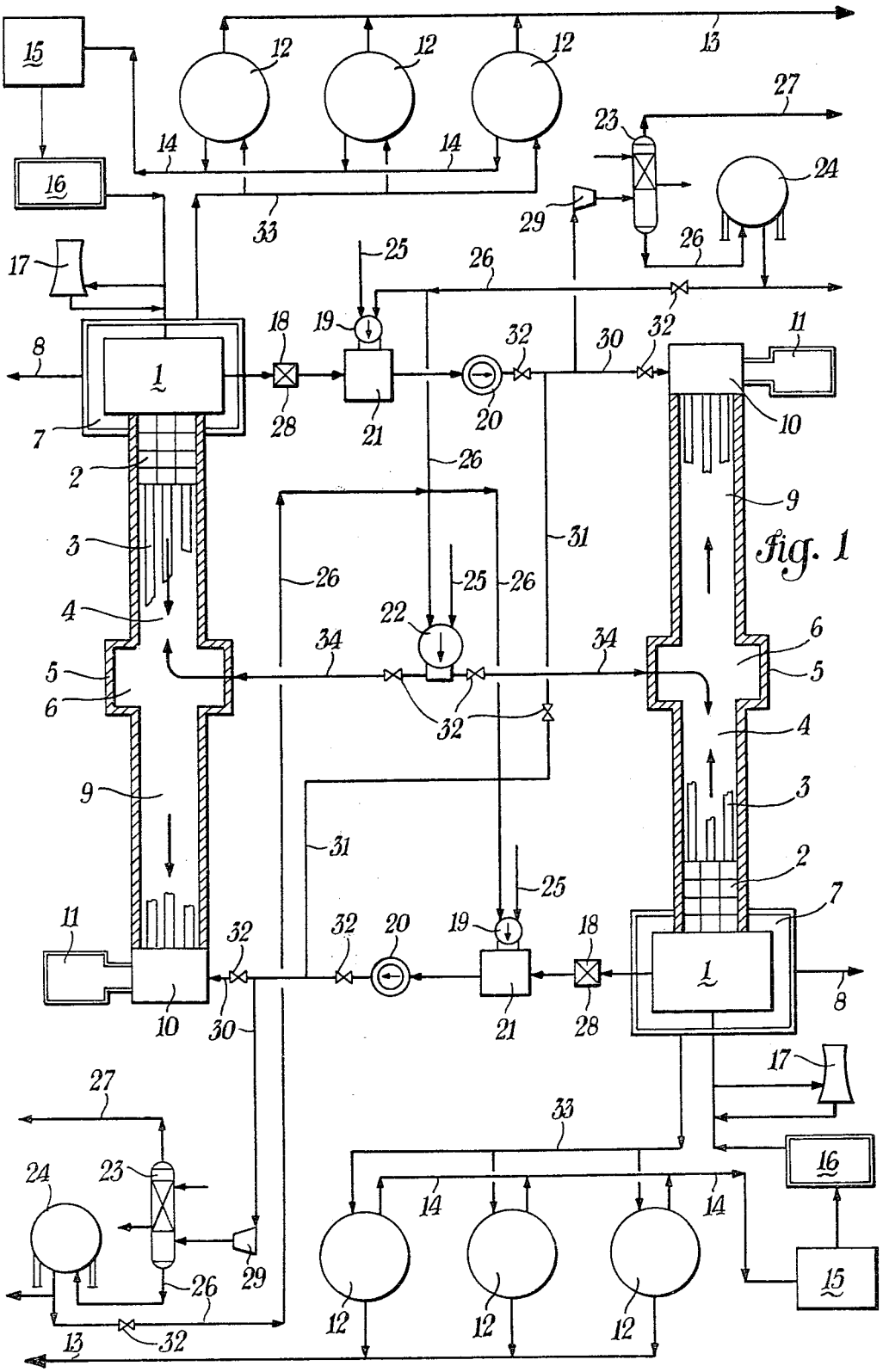
FIG. 1 shows a schematic view of the plant with two retort furnaces.
Figure 2:
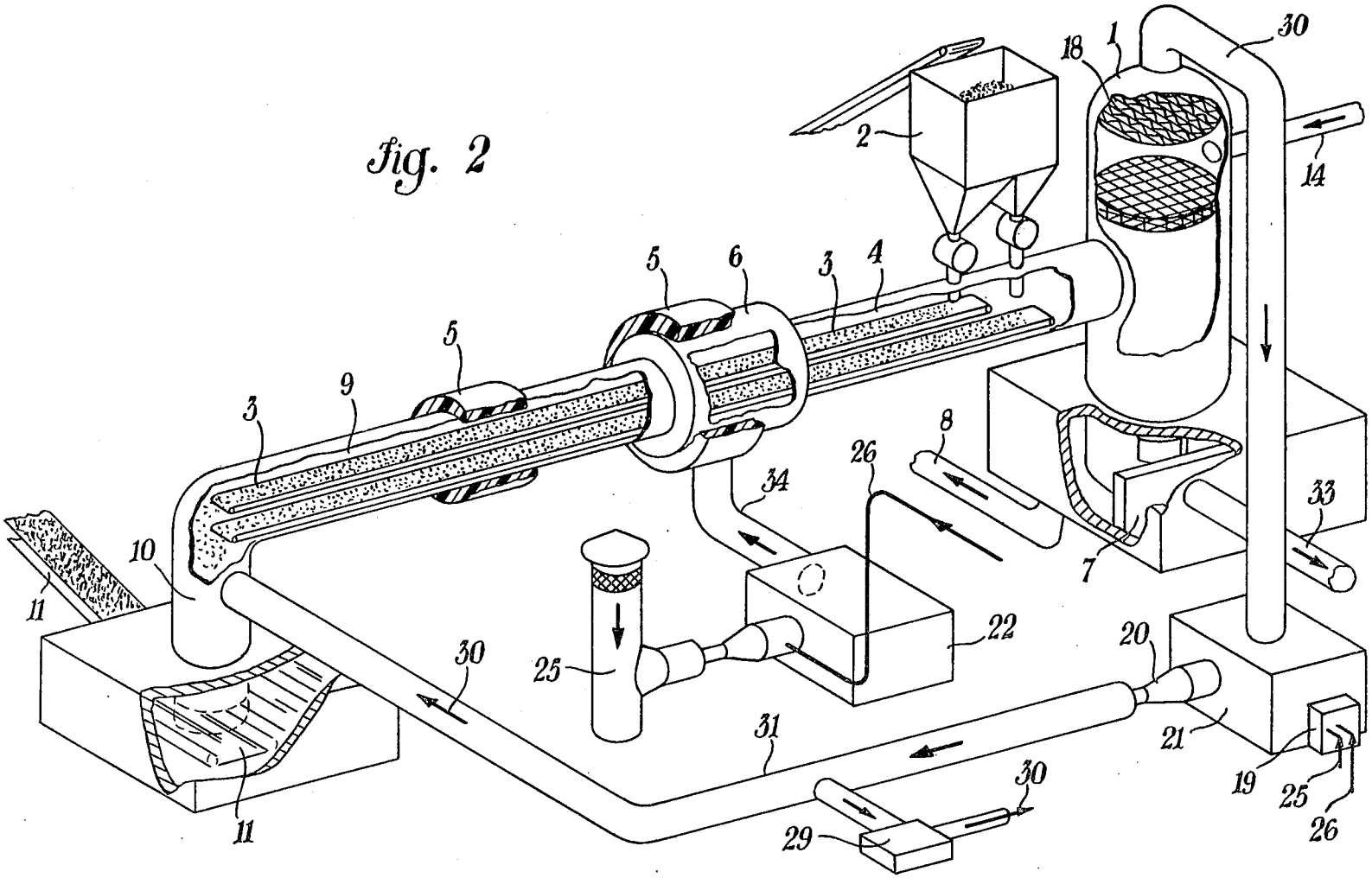
FIG. 2 shows the tunnel retort furnace with a direct contact condenser and one or more gas generation chambers.

With reference to FIGS. 1 and 2, 4 is the tunnel retort in which are operating one or more conveyors, on which are charged shales and/or sands to be processed preferably with suitable layer thickness by means of hoppers and feeders schematically indicated at 2, conveyors which may consists of belts, vibrating plates or apron type and on which the material to be transported is stirred by means of suitable devices.

The horizontal tunnel, which is composed for example by structures and by self-supporting sandwich panels of stainless steel plate with internal layers of insulating material, can be rectilinear straight or made of several rectilinear sections with the shape of an open or closed polygon in order to bring near to one another the two ends of the tunnel.

In FIGS. 1 and 2 the tunnel is rectilinear and has a thermal insulation 5 for reducing heat losses. The tunnel 4 is provided with one or more zones 6 for the admission of the hot combusted and oxygen-free gases 34, produced by means of burners 22 of gases or other fuels 26 and air 25, hot combusted gases which are admitted with a predetermined flow rate in the enlarged zones 6 of the tunnel in order to heat by direct contact the circulating process gases 30 which have been already preheated in the second part 9 of the tunnel by the exhausted retort shale and/or sands conveyed by conveyors 3 inside the tunnel.

As shown in FIG. 2, at the end 10 of the tunnel, the conveyors discharge the exhausted material into a basin of water which seals the end of the tunnel and in which an extraction system 11 such as a screw, belt conveyors, etc. discharges the shales or sands from said basin.

The oil products can be partially collected in liquid phase by means of channels, not illustrated in the drawings, placed under the conveyors and extracted from the tunnel retort and/or can evaporate from the shale or sands at a temperature up to 500° C. or more, because of the heat transmitted to the material to be retorted with a very efficient mechanism, i.e. by convection between the hot gases and shale oil or sands deposited on the conveyors with a very extended surface, and by conductivity between the material to be retorted and the conveyors which are heated by convection by the hot gases. The vaporized hydrocarbons and hot gases are carried by the same circulating gas to the head end of the tunnel 4 where, after the hoppers and the feeding mechanism, an upperly closed chamber is provided, which form the envlope of a direct contact condenser 1, in which water or cold oil products are used as cooling fluids. In the following description reference is made to a direct contact condenser, in which water is employed as cooling fluid.

The flow of the gas containing distilled oil products, gas from pyrolysis, process gases and the dust from the retorted materials, meets in counterflow finely dispersed water and is partially condensed, while the dust is scrubbed. As it is shown from FIG. 2, the incondensable gas, i.e. nitrogen, carbon dioxyde, hydrogen, light hydrocarbons, etc. are extracted from the upper part of the condenser 1, and represent the circulating gases 30. In the meantime the dust is collected as slurry and discharged by a duct from the lower part of the condenser 1.

The oil products, condensed in the condenser 1, emulsionated with water, flow into a closed basin 7 beneath the condenser 1 for a first decanting operation and then the emulsion is extracted from the basin 7 and conveyed through the pipe lines 33 to the decanting tanks 12 where the oil products are separated from water and sent to the possible further treatments 13.

The water is taken off from the tanks 12 and with a pipe system 14 is conveyed to a treatment plant 15 and to a storage container 16 and/or to a cooling tower 17.

Water from 16 and/or 17 is put again in circulation for continuing the condensation of oil products and throwing down the dusts.

The uncondensable and process gases from 1 are dried by means of drift separators 18 and the water is removed from said separators by means of drains 28 of the separator 18 and sent to the treatment plant 15 in case of the separators 18 put outside of 1. The gas coming from 1 and 18 is furtherly and possibly heated in the chamber 21 by direct contact with a small flow-rate of combusted gases produced with burner 19 for raising the gas temperature over the dew-point in order to avoid condensation and corrosion of fans 20 and ducts. A part of the process gas flow rate 30 is in excess because it has been introduced in the plant with the combusted gases 34 produced in 22 and because it has been produced by distillation of uncondensable products in the tunnel, and therefore it is sent to a compressor 29 and to a separation device, schematically indicated with 23, where light hydrocarbons 26 with high calorific power are obtained and conveyed into the tanks 24. A part of these hydrocarbons are used with or without other fuels in the burners 19 and 22.

The uncondensable gases from the device 23 are discharged or conveyed to treatment and utilization by line 27.

The gases 30 continue the process and are conveyed by the fans 20 again to the chamber 10 at the tail end of the tunnel, as indicated in the FIGS. 1 and 2 through the duct 31 or can start again the process in a second tunnel identical to the first one as indicated in FIG. 1. This arrangement permits the elimination of the circulating conduit 31, because, due to the layout and to the symmetry of the tunnels, the fans 20 of one plant send directly the gas 30 to the tail end of the second plant: therefore the second tunnel has also the function of the conduit 31. Nevertheless, the circulating conduit 31 can be envisaged also in the case of the two symmetrical plants, as it is shown in FIG. 1, and it allows by means of the by pass valves 32 the operation of only one plant, leaving the other stand by for maintenance. If the tunnel, instead of being straight-rectilinear has the shape of a polygonal with the two ends close one to another, the conduit 31 can be of a very reduced length.

The invention has been described with reference to a preferred embodiment thereof, but it is clear that modifications, changes and improvements may be adopted without departing from the scope of the present invention.

What I claim is:

1. A continuous process for retorting oil products from shale and/or sand material, comprising the steps of, conveying a layer of said material through a horizontal retort while supporting the material on a metal body, flowing a gaseous stream through the retort countercurrently to said layer of material, burning fuel at a location outside the retort to provide a supply of hot combusted gases, heating said countercurrently flowing gaseous stream by adding said combusted gases thereto at one or more input zones in the horizontal retort, said heated gaseous stream flowing horizontally through the horizontal retort to exchange heat convectively with the metal body and the material and the retort walls which face the material, whereby the metal body exchanges heat with the material by conduction and the retort walls exchange heat with the material by radiation, said material being heated to vaporize at least some of the oil products contained in said material, removing vapors from said retort, condensing said vapors and removing dust therefrom to provide an oil-containing condensate and a stream of uncondensed vapors, decanting said oil-containing condensate and removing carbon dioxide, hydrogen, light hydrocarbon fractions, nitrogen and steam as the stream of uncondensed vapors, and recycling at least a portion of said uncondensed vapors into the retort as said gaseous stream.

2. A process according to claim 1 wherein the condensation step is performed in a condensation chamber by bringing a condensing fluid into direct contact with the vapors removed from the retort, the decanting step being performed on the mixed condensing fluid and condensate beneath the condensation chamber, the liquids from the decanting step being delivered to a plurality of separators, said liquids being further decanted in said separators to remove the constituents of the condensate from the condensing fluid.

3. A process according to claim 1 including the steps of controlling the thickness of the material conveyed through the horizontal retort, controlling the speed of the conveyor, and controlling the quality and temperature of the heated gaseous stream in the retort, sealing the retort from the atmosphere, and promoting the efficacy of the sealing step by maintaining the heated gaseous stream in the retort at a pressure which is about at atmospheric pressure.

* * * * *